United States Patent [19]

Stratman

[11] 4,013,388

[45] Mar. 22, 1977

[54] SUPPORT MEANS FOR FLOATING ROTARY RING MEMBER

[75] Inventor: Paul E. Stratman, Minneapolis, Minn.

[73] Assignee: Safe Way Hydraulics, Inc., Minneapolis, Minn.

[22] Filed: Oct. 6, 1975

[21] Appl. No.: 619,563

[52] U.S. Cl. ..... 418/108; 418/171

[51] Int. Cl.[2] ..... F04C 1/06

[58] Field of Search ..... 418/107, 108, 169, 170, 418/171

[56] References Cited

UNITED STATES PATENTS

| | | | |
|---|---|---|---|
| 3,512,906 | 5/1970 | Molly | 418/170 X |
| 3,676,027 | 7/1972 | Molly | 418/170 X |
| 3,824,047 | 7/1974 | McDermott | 418/171 |

*Primary Examiner*—C. J. Husar
*Assistant Examiner*—Leonard Smith
*Attorney, Agent, or Firm*—Merchant, Gould, Smith, Edell, Welter & Schmidt

[57] ABSTRACT

Bearing equipped mounting members for mounting a rotor within a rotor chamber of a rotary fluid pressure displacement device. The rotor chamber has axially spaced end walls, and a peripheral wall including a pair of diametrically opposed arcuate walls and a pair of circumferentially spaced radially inwardly opening recesses intermediate the arcuate walls. The rotor has a cylindrical surface of a diameter less than the diameter of the arcuate walls to provide greater than normal running clearance therebetween, and the mounting members are disposed within the recesses for running engagement with the rotor.

2 Claims, 4 Drawing Figures

SUPPORT MEANS FOR FLOATING ROTARY RING MEMBER

BACKGROUND OF THE INVENTION

This invention is in the nature of an improvement over the structure disclosed and claimed in prior U.S. Pat. No. 3,824,047, issued to Hugh L. McDermott. In the structure disclosed in U.S. Pat. No. 3,824,047, a pair of mounting members are made each in one piece of resilient material, being formed to provide an elongated body that engages the radially inwardly facing bottom of a recess, and in-turned ends which engage the outer cylindrical surface of a rotor to provide bearing means for the rotor. In some instances, material having the resilient qualities needed for biasing the ends of a mounting member into sliding engagement with a rotor is not the best bearing material for a rotor of a given material. Thus, in some cases, early and undue wear occurs, either on the rotor or on the mounting member.

SUMMARY OF THE INVENTION

The present invention involves a rotary fluid displacement device comprising a housing defining a rotor chamber having a peripheral wall defining a pair of diametrically opposed arcuate wall surfaces and a pair of circumferentially spaced radially inwardly opening recesses between the arcuate wall surfaces. The recesses each have a radially inwardly facing surface portion and opposite end surfaces angularly displaced from the inwardly facing surface portion thereof, the end surfaces extending generally radially inwardly toward the arcuate surfaces. Rotor means in the chamber has a cylindrical outer surface, the arcuate wall surfaces having a diameter greater than the outer cylindrical wall surface of the rotor means to provide greater than normal running clearance between the arcuate wall surfaces and the rotor means. A pair of mounting members are each disposed in a different one of said recesses and each include an elongated body portion of flexible resilient material and a pair of generally radially inwardly projecting bearing elements secured to opposite ends of the body portion. One of the portions of each recess and its respective mounting member is longitudinally flat and the other thereof is curved so that each body portion engages its respective radially inwardly facing surface portion intermediate the ends of each thereof. The bearing elements have radially inner edges for sliding engagement with circumferentially spaced portions of the cylindrical outer surfaces of the rotor means. The bearing elements are yielding urged into sliding engagement with said outer cylindrical surface by engagement of the body portions with said inwardly facing recess surfaces.

DETAILED DESCRIPTION OF THE PREFERRED EMBODIMENT

Figure 1:
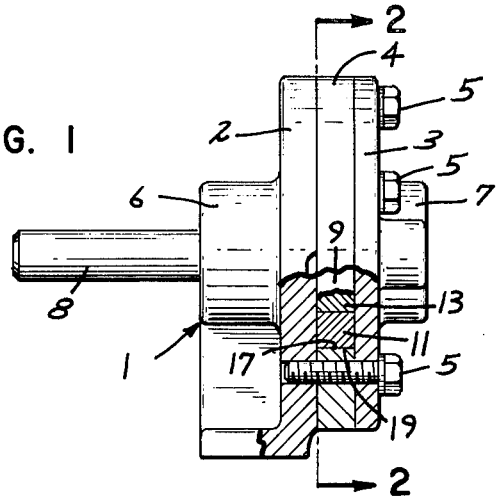
FIG. 1 is a view in side elevation of a rotary fluid displacement device, some parts being broken away and some parts being shown in section.
Figure 2:
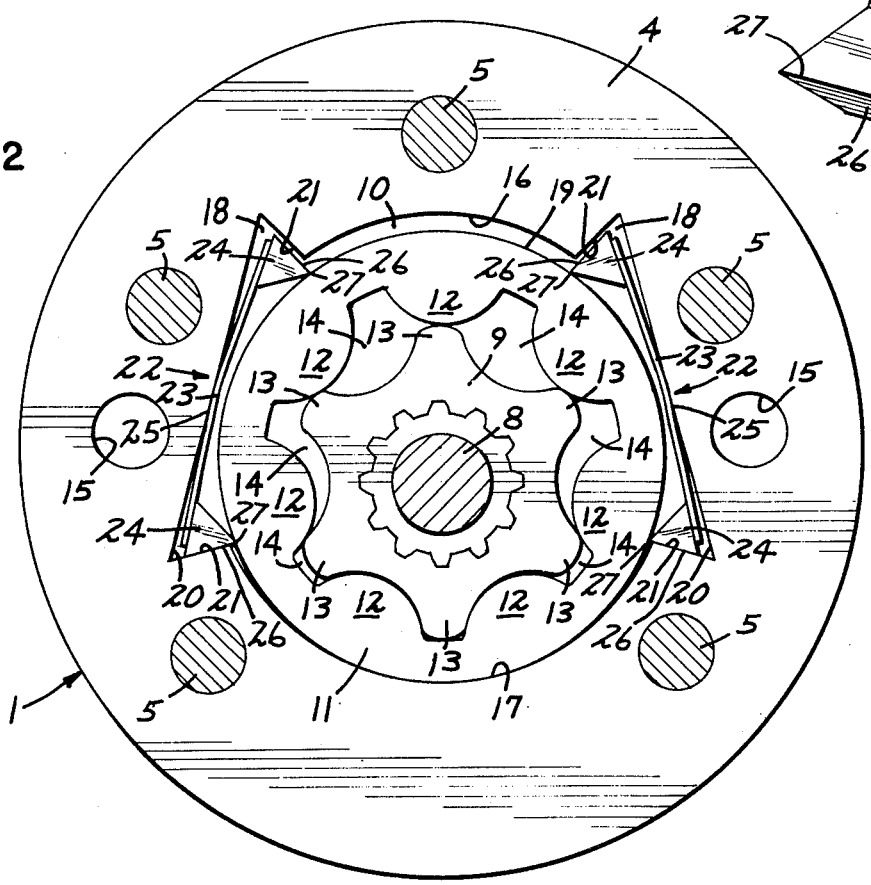
FIG. 2 is an enlarged transverse section taken on the line 2—2 of FIG. 1.

In FIGS. 1 and 2, a rotary fluid displacement device is shown, the same being used selectively as a fluid pump or motor, the same comprising a housing 1 including end sections 2 and 3 and an intermediate housing section 4, the housing sections being secured together by machines screws or the like 5. The end housing sections 2 and 3 are formed to provide bearing bosses 6 and 7 respectively which journal a rotary shaft 8 on which is splined or otherwise rigidly secured an externally toothed star member 9. The housing sections 2–4 cooperate to define a generally cylindrical rotor chamber 10 which contains the externally toothed star member 9 and a cooperating internally toothed ring member or rotor 11. The rotor 11 has internal teeth 12 that are one more in number than the external teeth 13 of the star member 9, and rotates on its own axis during rotation of the shaft 8 and star member 9, the teeth 12 and 13 moving successively into and out of registration with each other during rotation of the star member 9 and rotor 11. The member 9 and rotor 11 cooperate to define fluid chambers 14 which successively expand and contract during rotation of the members 9 and 11. As shown in FIG. 2, the intermediate housing section 4 is provided with passageways 15 which may be assumed to communicate with generally opposite ones of the chambers 14, and with inlet and outlet ports, not shown. The fluid passage arrangement may be assumed to be substantially identical to that shown in the abovementioned McDermott U.S. Pat. NO. 3,824,047.

The fluid pressure displacement device so far described does not in and of itself comprise the instant invention except as follows, in connection with the intermediate housing section 4. The housing section 4 has an inner peripheral wall defining a pair of diametrically opposed arcuate wall surfaces 16 and 17 and a pair of circumferentially spaced radially inwardly opening recesses 18 between the arcuate wall surfaces 16 and 17 and at generally opposite sides of the chamber 10. The diameter between the arcuate wall surfaces 16 and 17 is greater than that of the rotor 11, so as to provide slightly greater than normal running clearance between the arcuate wall surfaces 16 and 17 and the outer cylindrical surface 19 of the rotor 11. In the embodiment of the invention illustrated, and with reference particularly to FIG. 2, it will be seen that the recesses 18 are each defined in part by a radially inwardly facing longitudinally flat surface portion 20 and generally flat opposite end surfaces 21 that extend generally radially inwardly from opposite ends of their respective surface portion 20 to respective arcuate surfaces 16 and 17.

Figure 3:
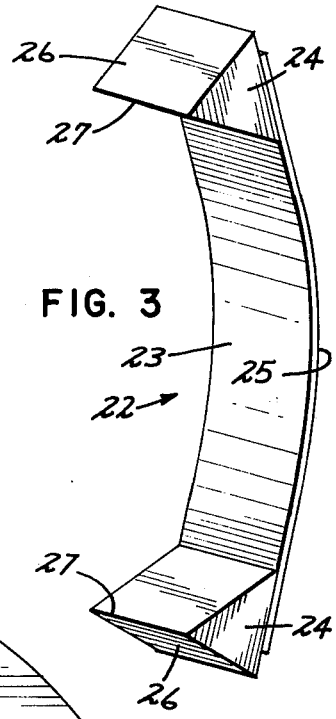
FIG. 3 is an enlarged view in perspective of one of the mounting members of this invention.
Figure 4:
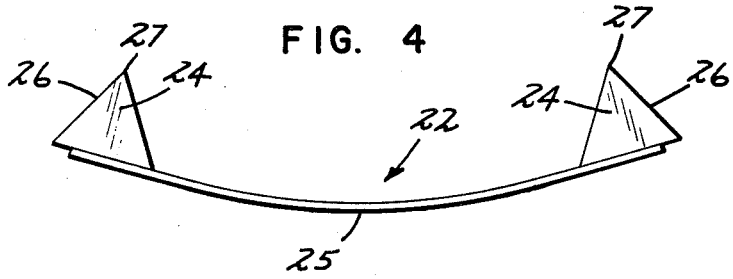
FIG. 4 is a view in side elevation of the mounting member of FIG. 3.

A pair of mounting members 22 are disposed one each in a different one of the recesses 18, each of the mounting members comprising an elongated body portion 23 preferably made from flexible resilient sheet material, such as spring steel, bronze alloy or other suitable material, and a pair of generally radially inwardly projecting bearing elements 24 each secured to an opposite end of their respective body portion 23. As shown in FIGS. 3 and 4, the body portions 23 are curved in directions longitudinally thereof and have convex outer surfaces 25 that engage the radially inwardly facing surface portions 20 of the recesses 18. Preferably and as shown, the bearing elements 24 are generally triangular in cross-sectional shape, having flat outer end surfaces 26 and radially inner edges 27 that make sliding engagement with the cylindrical surface 19 of the rotor 11 when the mounting members 22 are placed in their respective recesses 18. The corresponding dimensions of the mounting members 22 and their respective recesses 18 are such that, when the mounting members 22 are placed in the recesses 18, the body portions 23 become at least partially straightened, with the outer surfaces 25 thereof being pressed against their respective recess surface portions 20, so that the bearing elements 24 are yielding urged into engagement with the outer cylindrical surface 19 of the rotor 11. It will be noted that the longitudinal dimensions of the mounting members 22 and their respective recesses 18 are such that there exists a slight clearance between the outer surface 26 of one of the bearing elements 24 and its adjacent recess end surface portion 21 when the opposite bearing element 24 is in sliding engagement with its adjacent end surface portion 21. It will be further noted that each outer end surface 26 is substantially parallel to its adjacent end surface portion 21, so that relatively free sliding movement is obtained between each bearing element 24 and its adjacent recess end wall surface portion 21. Preferably, each bearing element 24 is made from a material that is compatible with that of the rotor 11, so that good sliding engagement is obtained therebetween.

It will be appreciated that, by providing mounting members such as the members 22, the diameter of the arcuate surfaces 16 and 17 may be such as to eliminate contact therebetween and the cylindrical surface 19 of the rotor 11 so that free running movement of the rotor 11 is obtained. Further, the bearing elements 24 urge the rotor 11 toward a position wherein good sealing contact is had between the teeth 12 and 13 of the rotor 11 and star member 9.

What is claimed is:

1. A rotary fluid displacement device comprising a housing defining a rotor chamber having a peripheral wall defining a pair of diametrically opposed arcuate wall surfaces and a pair of circumferentially spaced radially inwardly opening recesses between said arcuate wall surfaces, said recesses each having a radially inwardly facing surface portion and opposite end surfaces angularly displaced from the inwardly facing surface portion thereof and extending generally radially inwardly toward said arcuate surfaces; rotor means in said chamber having a cylindrical outer surface, said arcuate wall surfaces having a diameter greater than that of the outer cylindrical wall surface of said rotor means to provide greater than normal running clearance between said arcuate wall surfaces and said rotor means; characterized by a pair of mounting members each disposed in a different one of said recesses and each including an elongated body portion of flexible resilient material and a pair of generally radially inwardly projecting bearing elements secured to opposite ends of the body portion; one of said portions of each recess and its respective mounting member being longitudinally flat and the other thereof being curved so that each body portion engages its respective radially inwardly facing surface portion intermediate the ends of each thereof; said bearing elements comprising triangular blocks having radially inner edges for sliding engagement with circumferentially spaced portions of the cylindrical outer surface of said rotor means; said bearing elements being of a material that is compatible with the material of said rotor means, whereby good sliding engagement between said radially inner edges and said rotor means is obtained; said bearing elements being yieldingly urged into said sliding engagement with said outer cylindrical surface by engagement of said body portions with said inwardly facing recess surfaces, said bearing elements having flat outer end surfaces arranged for sliding engagement with the end surface of their respective recesses.

2. The rotary fluid displacement device defined in claim 1 in which said inwardly facing surface portions of the recesses are longitudinally flat, said mounting member body portions being curved in directions longitudinally thereof and having convex outer surfaces engaging the inwardly facing surface portions of their respective recesses.

* * * * *